US006792404B2

(12) United States Patent
Jacob

(10) Patent No.: US 6,792,404 B2
(45) Date of Patent: Sep. 14, 2004

(54) STI MEASURING

(75) Inventor: Kenneth Dylan Jacob, Framingham, MA (US)

(73) Assignee: Bose Corporation, Framingham, MA (US)

( * ) Notice: Subject to any disclaimer, the term of this patent is extended or adjusted under 35 U.S.C. 154(b) by 374 days.

(21) Appl. No.: 09/766,933

(22) Filed: Jan. 22, 2001

(65) Prior Publication Data

US 2002/0099551 A1 Jul. 25, 2002

(51) Int. Cl.[7] ..... G10L 11/00

(52) U.S. Cl. ..... 704/228; 704/270

(58) Field of Search ..... 73/589; 381/103, 381/122, 94.3; 704/260, 228, 201, 202, 267, 200.1, 270

(56) References Cited

U.S. PATENT DOCUMENTS 4,631,749 A * 12/1986 Rapaich ..... 381/103
5,684,251 A * 11/1997 Arcas et al. ..... 73/589
5,867,813 A * 2/1999 Di Pietro et al. ..... 704/202
6,134,968 A * 10/2000 Kunze et al. ..... 73/589

OTHER PUBLICATIONS

John Haynes, Speech Intelligibility . . . (New technologies enhance fire protection and life safety), copyright 2002.*

Gold–line to debut STI measurement tool at NSCA Expo 2002, http://www.prosoundweb.com/webexpo/nsca02/news/goldline.shtml, copyright 2002.*

SimplexGrinnell and Gold Line Jointly Announce a New Technology for Complying with Fire Alarm System Voice Intelligibility Requirements, http://www.simplexgrinnell.com/news_events/press_releases/simplexgrinnell/2002goldline.jsp, copyright 2002.*

Steeneken et al., Development of an Accurate, Handheld, Simple–to–use Meter for the Prediction of Speech Intelligibility, Nov. 16, 2001.*

* cited by examiner

*Primary Examiner*—Tālivaldis Ivars Šmits
*Assistant Examiner*—Jakieda R Jackson
(74) *Attorney, Agent, or Firm*—Fish & Richardson P.C.

(57) ABSTRACT

A handheld audio spectrum analyzer includes a stored STI measurement algorithm and a selector for selecting the stored STI measurement algorithm to process a transduced sound signal received by a microphone associated with the handheld audio spectrum analyzer to provide the STI between the microphone and the source of the sound signal that transduces an audio test signal related to the STI measurement algorithm stored in the handheld audio spectrum analyzer.

5 Claims, 1 Drawing Sheet

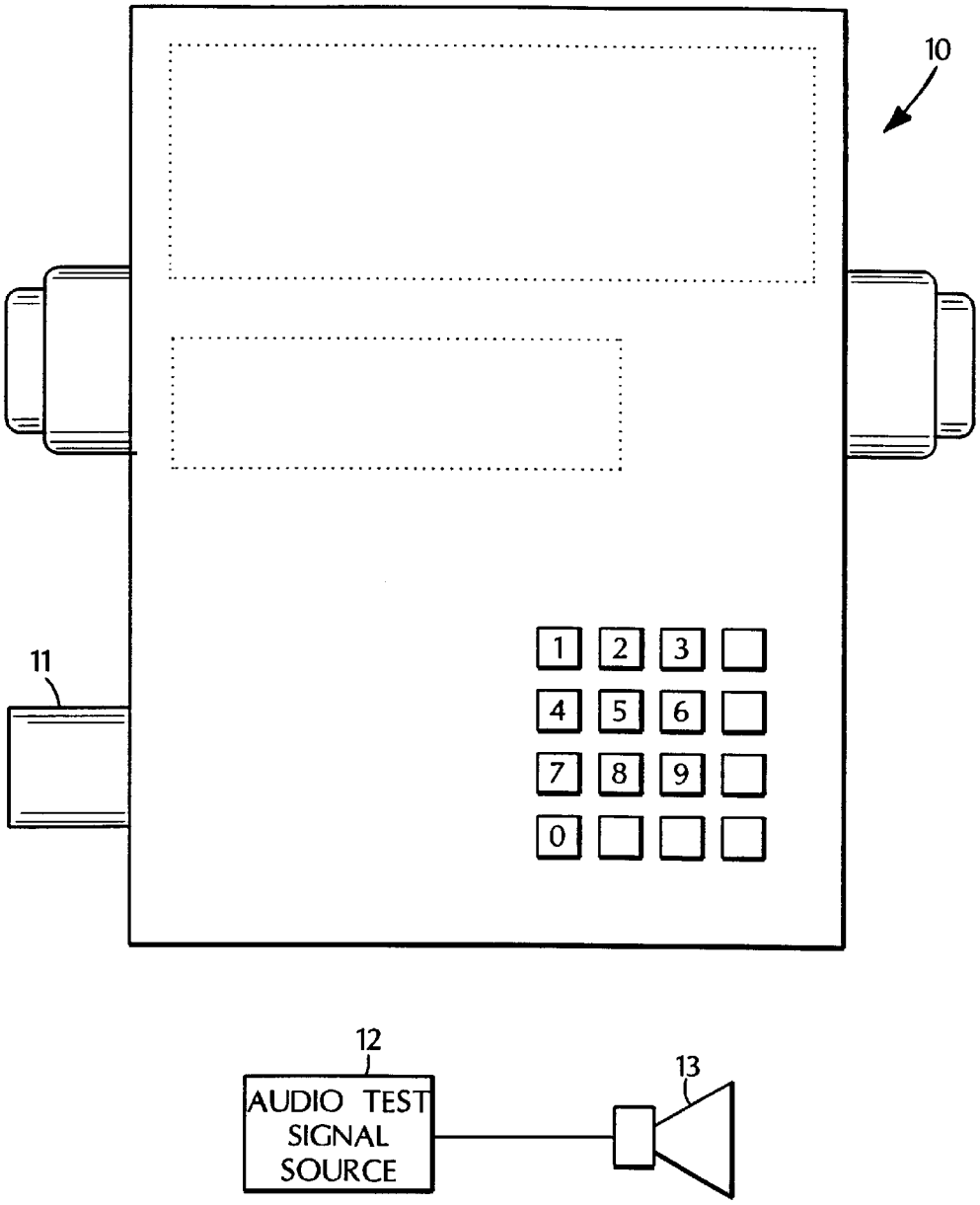
FIGURE

STI MEASURING

CROSS-REFERENCE TO RELATED APPLICATIONS

Not Applicable.

STATEMENT REGARDING FEDERALLY SPONSORED RESEARCH OR DEVELOPMENT

Not Applicable.

The present invention relates in general to STI measuring and more particularly concerns novel apparatus and techniques for measuring speech transmission intelligibility (STI).

BACKGROUND OF THE INVENTION

For background, reference is made to the Bruel & Kjaer Speech Transmission Meter Type 3361 consisting of Transmitter Type 4425 Receiver Type 4419 that is commercially available and the manual therefor, all incorporated by reference herein. Reference is also made to the Gold Line Model DSP30/DSP30A audio spectrum analyzer and the manual therefor, all incorporated by reference herein.

RASTI (Rapid Speech Transmission Index) relates to a method of measuring speech intelligibility. The method is based on measuring the reduction in signal modulation between a source of speech, such as a loudspeaker, and listeners. The aforesaid Speech Transmission Meter Type 3361 measures RASTI values directly using the Transmitter Type 4225 for sending a special test signal, and Receiver Type 4419 for analyzing the received signal and calculating the RASTI value.

It is an important object of the invention to provide improved methods and means for measuring STI.

BRIEF SUMMARY OF THE INVENTION

According to the invention, a handheld sound analyzer includes a stored Speech Transmission Index (STI) measurement algorithm and a selector for processing a received test sound signal to cause the analyzer to indicate the STI of the received test sound signal. The test sound signal is typically provided by an audio test signal source, such as comprising a CD, tape, MP-3, or other suitable storage medium, having a known audio test signal related to the STI measurement algorithm that is transduced by a source of the test sound signal, such as a loudspeaker, and received by a microphone of the handheld analyzer that transduces the received sound signal into a corresponding electrical test signal that is analyzed in accordance with the stored STI measurement algorithm to produce an indication of the STI between the loudspeaker and the analyzer microphone.

Numerous other features, objects and advantages of the invention will become apparent from the following detailed description when read in connection with the accompanying drawing.

BRIEF DESCRIPTION OF THE DRAWING

A view of a system including a handheld audio spectrum analyzer illustrating the STI selector and source of test sound signal according to the invention.

DETAILED DESCRIPTION

With reference now to the drawing, there is shown a view of a Gold Line Model DSP 30/DSP 30A handheld audio spectrum analyzer 10 having a selector 11 for activating an STI measurement in accordance with the invention. An audio test signal source 12 provides a test audio signal that is transduced by loudspeaker 13 to produce a sound signal that is transduced by the microphone of the handheld audio spectrum analyzer 11, which may be a Gold Line Model DSP 30/DSP 30A audio spectrum analyzer modified to include selector 11 and a stored STI measurement algorithm, typically stored in a memory chip. Audio test signal source 12, which may comprise a CD player, MP3 player, tape player or other suitable audio signal source, provides an audio test electrical signal to loudspeaker 13 that produces a test sound signal received by the microphone of handheld audio spectrum analyzer 10. The audio test signal is related to the stored STI measurement algorithm signal stored in handheld audio spectrum analyzer 10 and may be repeatedly played with actuation of selector 11 resulting in display of the STI between loudspeaker 13 and handheld audio spectrum analyzer 10, allowing making a number of measurements as the microphone of handheld audio spectrum analyzer 10 is moved from position to position independently of the location of audio test signal source 12. For example, the audio test signal source may be located in the basement of a high-rise building while the handheld audio spectrum analyzer microphone, usually in the handheld audio analyzer, moves from location-to-location on each floor of the high-rise building to evaluate the STI, for example, of a fire alarm system in the building.

A feature of the invention is that the handheld audio spectrum analyzer may be readily and rapidly moved from location to location and need not be tethered to the audio test signal source. The invention is relatively inexpensive and may be included in a handheld audio spectrum analyzer that may perform other functions.

It is evident that those skilled in the art may now make numerous uses and modifications of and departures from the specific apparatus and techniques disclosed herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. STI measuring apparatus comprising:

a handheld audio spectrum analyzer having a microphone, a STI measurement algorithm store carried by the handheld audio spectrum analyzer storing a STI measurement algorithm related to a known test audio signal, said handheld audio spectrum analyzer having a selector constructed and arranged to coact with the STI measurement algorithm store to process an electrical signal transduced by the microphone in response to a test sound signal related to the stored STI measurement algorithm produced by transduction of an audio test signal to process an electrical received signal transduced by the microphone to display the STI between the microphone and the source of the test sound signal received by the microphone.

2. STI measuring apparatus in accordance with claim 1 and further comprising:

a source of said audio test signal, an electroacoustical transducer constructed and arranged to provide said test sound signal and coupled to the source of said audio test signal.

3. STI measuring apparatus in accordance with claim 2 wherein said source of said audio test signal comprises a CD.

4. A method of STI measuring with a handheld audio spectrum analyzer having a microphone comprising:

transducing an audio test signal related to a known STI measurement algorithm stored in the handheld audio spectrum analyzer, transducing the audio test signal to provide a corresponding sound signal, receiving the sound signal with the microphone to provide a transduced received signal, and processing the transduced received signal in accordance with the stored STI measurement algorithm to provide a signal representative of the STI between the microphone and the source of the sound signal.

5. A method of STI measuring in accordance with claim 4 and further comprising:

moving the handheld audio analyzer to a different location while the source of the audio test signal remains stationary, and repeating the method of claim 4 to provide a signal representative of the STI between the different location and the source of the corresponding sound signal.

* * * * *